US008531497B2

(12) United States Patent
Motoyama

(10) Patent No.: US 8,531,497 B2
(45) Date of Patent: Sep. 10, 2013

(54) IMAGE FORMING APPARATUS AND CONTROL METHOD THEREOF

(75) Inventor: Masanao Motoyama, Tama (JP)

(73) Assignee: Canon Kabushiki Kaisha, Tokyo (JP)

( * ) Notice: Subject to any disclaimer, the term of this patent is extended or adjusted under 35 U.S.C. 154(b) by 895 days.

(21) Appl. No.: 12/145,421

(22) Filed: Jun. 24, 2008

(65) Prior Publication Data

US 2009/0003861 A1 Jan. 1, 2009

(30) Foreign Application Priority Data

Jun. 26, 2007 (JP) ..... 2007-168085

(51) Int. Cl.
*B41J 15/14* (2006.01)
*B41J 27/00* (2006.01)
*B41J 2/435* (2006.01)

(52) U.S. Cl.
USPC ..... 347/243; 347/248; 347/259; 347/260

(58) Field of Classification Search
USPC ..... 347/116, 229, 234, 235, 248–250, 347/243, 259, 260
See application file for complete search history.

(56) References Cited

U.S. PATENT DOCUMENTS 7,595,812 B2 * 9/2009 Maeda ..... 347/234

FOREIGN PATENT DOCUMENTS

| | | | |
|---|---|---|---|
| JP | 07-175005 | A | 7/1995 |
| JP | 2000-238342 | A | 9/2000 |
| JP | 2000-355122 | A | 12/2000 |
| JP | 2005-208578 | A | 8/2005 |

* cited by examiner

*Primary Examiner* — Uyen Chau N Le
*Assistant Examiner* — John M Bedtelyon
(74) *Attorney, Agent, or Firm* — Canon U.S.A., Inc., IP Division

(57) ABSTRACT

An image forming apparatus includes a light beam output unit configured to output a light beam, a deflection unit for deflection scanning in a main scanning direction of a photosensitive member by reflecting the light beam from the light beam output unit, a timing information detection unit configured to detect timing information of the deflection scanning by the deflection unit, a calculation unit configured to calculate a correction amount of the main scanning direction for a next scan based on the timing information, a light beam modulation control unit configured to generate a light beam modulation signal based on image data and the correction amount, and a drive unit configured to drive the light beam output unit based on the light beam modulation signal.

11 Claims, 7 Drawing Sheets

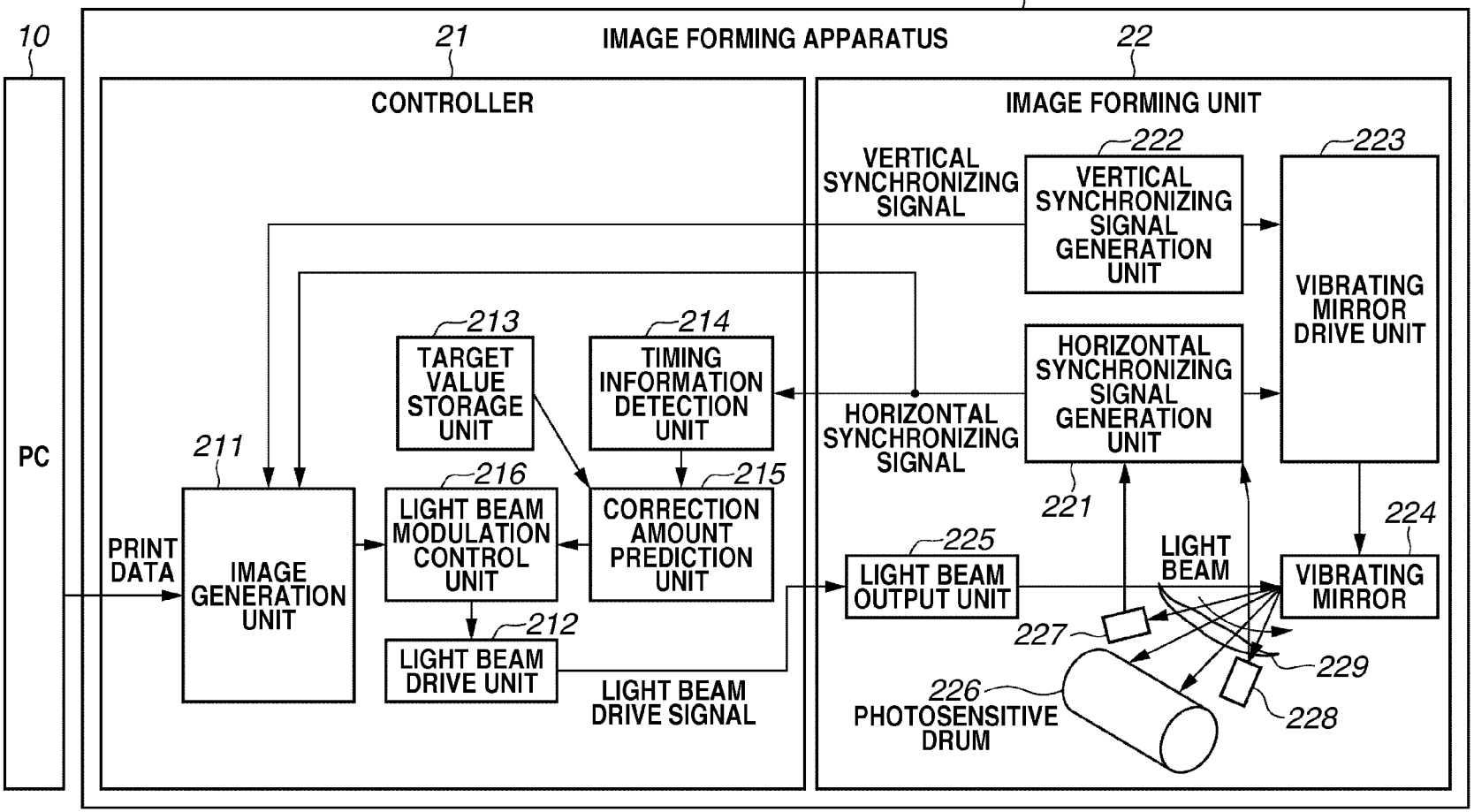
FIG.1
20
IMAGE FORMING APPARATUS
22
IMAGE FORMING UNIT
223
VIBRATING MIRROR DRIVE UNIT
224
VIBRATING MIRROR
229
228
222
VERTICAL SYNCHRONIZING SIGNAL GENERATION UNIT
HORIZONTAL SYNCHRONIZING SIGNAL GENERATION UNIT
221
LIGHT BEAM
227
226
PHOTOSENSITIVE DRUM
VERTICAL SYNCHRONIZING SIGNAL
HORIZONTAL SYNCHRONIZING SIGNAL
225
LIGHT BEAM OUTPUT UNIT
21
CONTROLLER
214
TIMING INFORMATION DETECTION UNIT
215
CORRECTION AMOUNT PREDICTION UNIT
LIGHT BEAM DRIVE SIGNAL
213
TARGET VALUE STORAGE UNIT
216
LIGHT BEAM MODULATION CONTROL UNIT
212
LIGHT BEAM DRIVE UNIT
211
IMAGE GENERATION UNIT
PRINT DATA
10
PC

IMAGE FORMING APPARATUS AND CONTROL METHOD THEREOF

BACKGROUND OF THE INVENTION

1. Field of the Invention

The present invention relates to an image forming apparatus and a control method thereof.

2. Description of the Related Art

Recently, in the field of image forming apparatuses using electrophotographic technology, there are constant demands for reductions in size and cost. To realize such reductions in size and cost, a method has been discussed (see Japanese Patent Application Laid-Open No. 07-175005) which uses a galvanomirror fabricated by a semiconductor fabrication technique instead of a conventionally-used polygonal mirror. In this method, an image is formed by making the mirror resonate at a specific resonant frequency which is based on the mechanical dimensions of the galvanomirror, and by scanning a light beam in the main scanning direction.

Further, for a nested mirror (Japanese Patent Application Laid-Open No. 2005-208578), there are the qualities that the available scanning area is considered a constant angular velocity, and that the scanning angle can be made larger. As a result, a correction optical system can be made to have a compact and simple structure, which is suitable for a scanning apparatus in a compact, low-cost image forming apparatus.

If a light beam is deflected using a technique such as that described above to make a vibrating mirror resonate, wobbles occur in the resonance due to turbulence or the like caused by air resistance during the resonance operation. The wobbles can produce non-periodic jitter.

This jitter becomes apparent as angular velocity jitter of the vibrating mirror and image forming position jitter in the main scanning direction such as that illustrated in FIG. 2A, which causes a difference in the width of the main scanning direction. This results in shake in the straight lines of the sub-scanning direction at the center and at the edges on the transfer medium, so that image quality deteriorates.

SUMMARY OF THE INVENTION

The present invention is directed to an image forming apparatus which predicts the non-periodic jitter of each scan, corrects according to the prediction, and satisfactorily holds an image forming position of the sub-scanning direction at the center and at the edges on the transfer medium during image formation.

According to an aspect of the present invention, an image forming apparatus includes a light beam output unit configured to output a light beam, a deflection unit for deflection scanning in a main scanning direction of a photosensitive member by reflecting the light beam from the light beam output unit, a timing information detection unit configured to detect timing information of the deflection scanning by the deflection unit, a calculation unit configured to calculate a correction amount of the main scanning direction for a next scan based on the timing information, a light beam modulation control unit configured to generate a light beam modulation signal based on image data and the correction amount, and a drive unit configured to drive the light beam output unit based on the light beam modulation signal.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 1 is a diagram illustrating a configuration example of an image forming apparatus according to an exemplary embodiment of the present invention.

DETAILED DESCRIPTION OF THE EMBODIMENTS

Figure 2B:
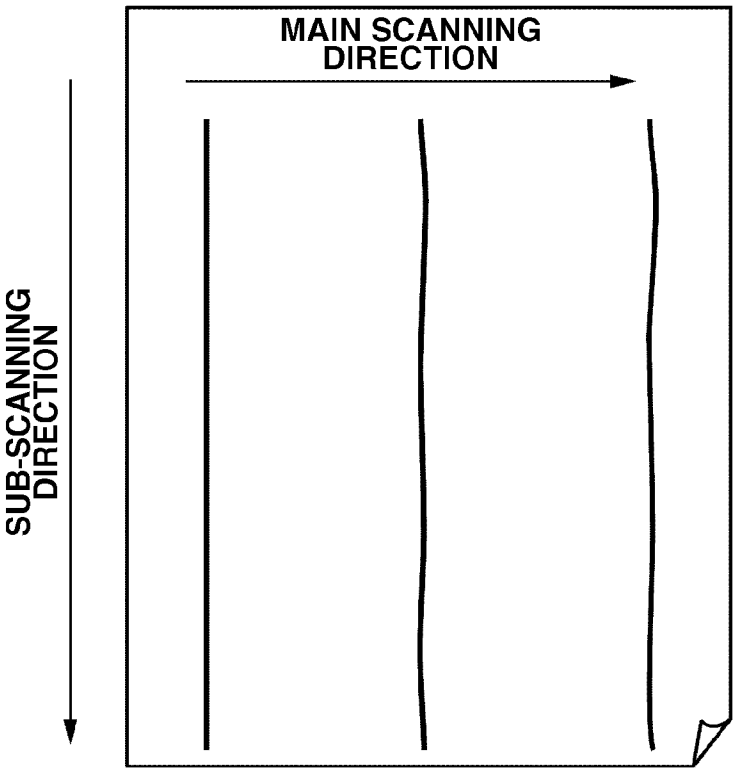
FIGS. 2A and 2B are diagrams respectively illustrating the degradation in image quality due to the jitter of a vibrating mirror, and the effects from an exemplary embodiment of the present invention.

Various exemplary embodiments, features, and aspects of the invention are described in detail below with reference to the drawings.

First Exemplary Embodiment

FIG. 1 is a diagram illustrating a configuration example of an image forming apparatus 20 according to an exemplary embodiment of the present invention. The image forming apparatus 20 includes a controller 21 and an image forming unit 22.

The controller 21 controls the whole apparatus by a not-illustrated central processing unit (CPU), and generates image data which can be output by the image forming unit 22 from print data received from an external personal computer (PC) 10. The image forming unit 22 develops an electrostatic latent image which was exposed on a photosensitive drum 226, transfers the developed image to a transfer medium, and performs transportation processing to output the formed image.

First, an image generation unit 211 in the controller 21 analyzes print data that the controller 21 received from a PC 10, performs image processing, and generates image data. The generated image data is output to a light beam drive unit 212 from the image generation unit 211 based on a requested timing of a vertical synchronizing signal output from the image forming unit 22.

A target value storage unit 213 stores a target value to be utilized in calculating a correction amount which is output by a correction amount prediction unit 215. While in the present exemplary embodiment the scanning time (timing information) of the main scanning direction is stored as the target value, the target value may be other information which can be utilized in predicting a correction amount, such as the resonant frequency of the mirror, main scanning line interval, and correction amount per scan.

A timing information detection unit 214 outputs timing information to the correction amount prediction unit 215 using a horizontal synchronizing signal output from the image forming unit 22.

The correction amount prediction unit 215 converts the timing information output by the timing information detection unit 214 into a parameter representing an operation of a vibrating mirror 224, and calculates a correction amount prediction value from the converted parameter and a target value which is stored in the target value storage unit 213. Based on the calculated correction amount prediction value, a modulation correction amount of the light beam is output to the light beam modulation control unit 216.

The light beam modulation control unit 216 outputs a light beam modulation signal for modulating the light beam to a light beam drive unit 212 based on the image data output from the image generation unit 211 and the modulation correction amount output from the correction amount prediction unit 215. By inserting or deleting a small pixel piece according to the correction amount, the light beam modulation control unit 216 partially or fully expands or contracts the scanning line length of the main scanning direction to adjust the drawing time.

Further, the adjustment method of the scanning line length of the main scanning direction is not limited to the above-described example. The adjustment method may also be performed by changing the clock frequency, which becomes a standard when drawing the image data, for all or part of the main scanning. However, if the clock frequency is changed using a technique such as a programmable phase-locked loop (PLL), the PLL is locked after the frequency change control has been performed. As a result, there is a time delay until the frequency is changed, or the time until being locked is indefinite. Thus, an adjustment method which inserts/deletes the above-described small pixel piece according to the pixel location is more suitable.

The light beam drive unit 212 drives a light beam output unit 225 of the image forming unit 22 according to the light beam modulation signal designated by the light beam modulation control unit 216. A vertical synchronizing signal generation unit 222 of the image forming unit 22 outputs a vertical synchronizing signal for synchronizing the writing-start position in the sub-scanning direction of the photosensitive drum 226 to the image generation unit 211. A horizontal synchronizing signal generation unit 221 outputs a horizontal synchronizing signal based on light beam detection information from a writing-start-side light beam timing detection unit 227 and a writing-end-side light beam timing detection unit 228 that are located proximal to the photosensitive drum 226. The horizontal synchronizing signal is input to the image generation unit 211, timing information detection unit 214, and vibrating mirror drive unit 223.

The vibrating mirror drive unit 223 drives the vibrating mirror 224. The vibrating mirror 224 reflects alight beam irradiated from the light beam output unit 225 and deflection-scans the light beam in a main scanning direction. The drive method of the vibrating mirror 224 may be electrostatic, electromagnetic, bimetal, piezoelectric, a combination of these, or other drive method.

The light beam output unit 225 makes the light beam blink using a light beam drive signal received from the light beam drive unit 212. The blinking light beam is reflected by the vibrating mirror 224 and passes through a constant linear velocity conversion optical system 229. The photosensitive drum 226 is scanned with the blinking light beam so that the photosensitive drum 226 is exposed.

The writing-start-side light beam timing detection unit 227 is a detection unit which detects the start of light beam scanning on the photosensitive drum 226, and outputs a light beam detection signal to the horizontal synchronizing signal generation unit 221. Further, the writing-end-side light beam timing detection unit 228 is a detection unit which detects the end of light beam scanning on the photosensitive drum 226, and outputs a light beam detection signal to the horizontal synchronizing signal generation unit 221.

Figure 3:
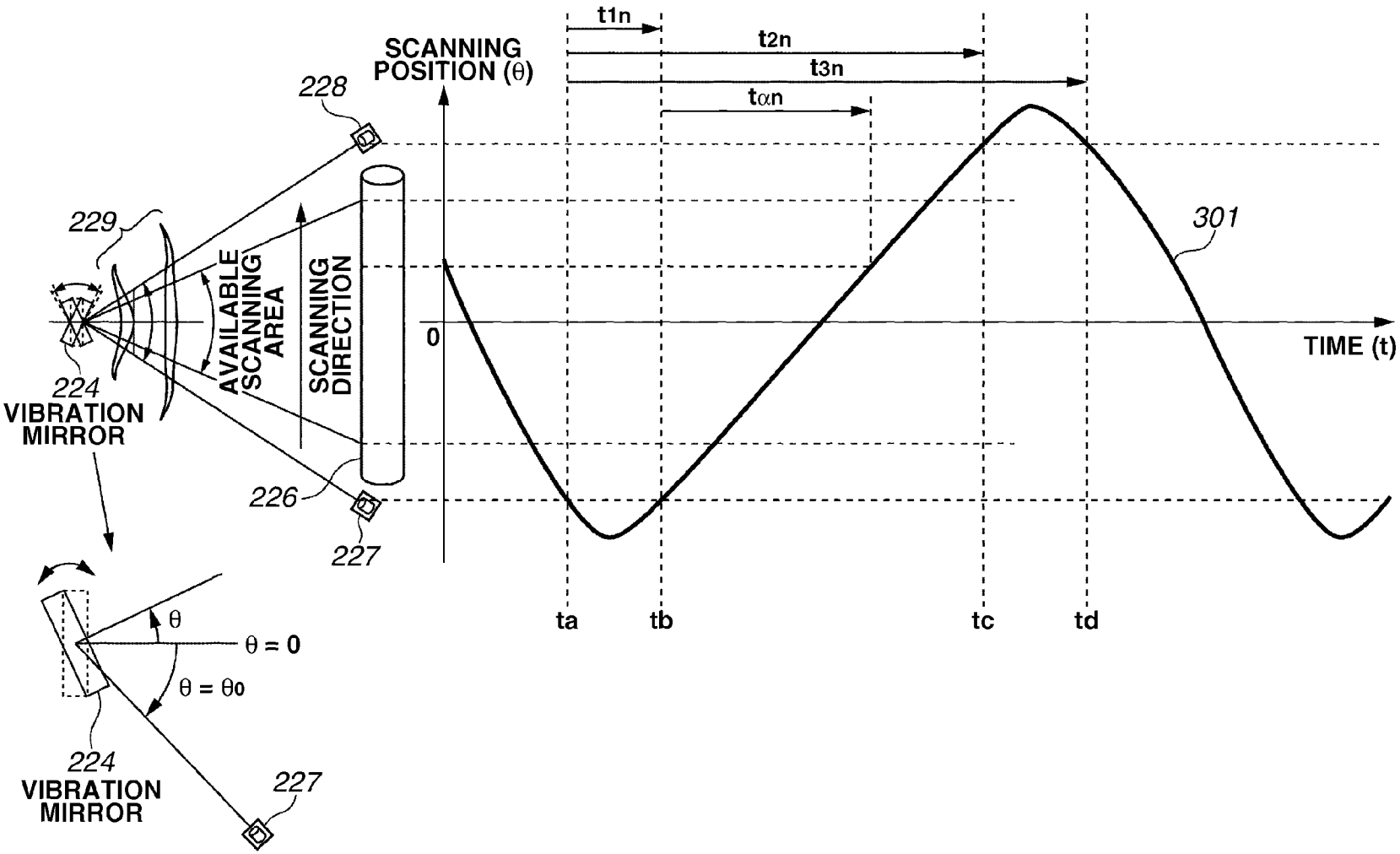
FIG. 3 is a diagram for describing the relationship between change in scanning position over time, and timing information and scanning line length according to a first exemplary embodiment of the present invention.
Figure 4:
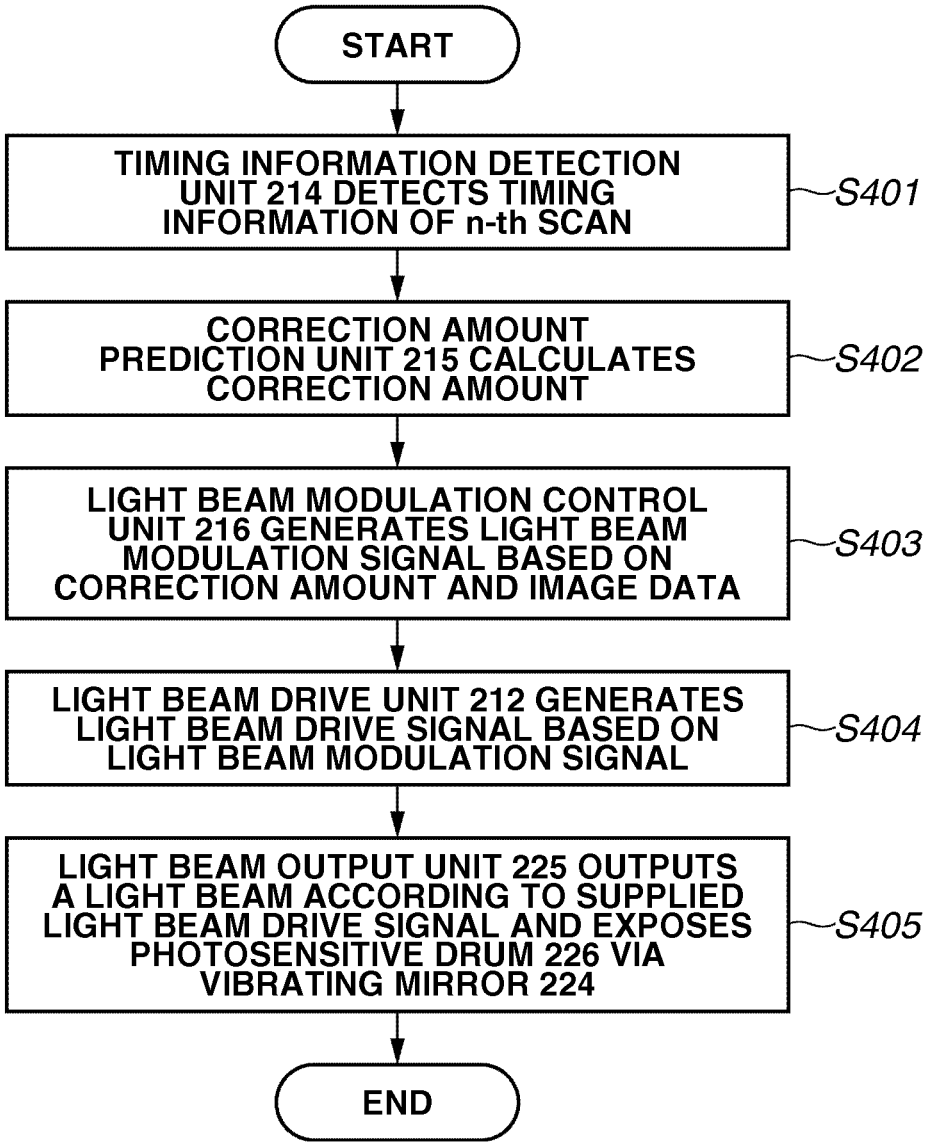
FIG. 4 is a flowchart illustrating one example of the processing according to the first exemplary embodiment of the present invention.

Next, the predicted correction processing of the non-periodic jitter of each scan in a main scanning direction according to the exemplary embodiment of the present invention is described with reference to FIGS. 3 and 4. FIG. 3 is a diagram describing the relationship between the change in scanning position over time made by the vibrating mirror 224, and the timing information and scanning line length detected by the timing detection units 227 and 228. FIG. 4 is a flowchart of the processing according to the present exemplary embodiment. The processing corresponding to FIG. 4 is executed based on a processing program corresponding to the respective processing units of FIG. 1.

In FIG. 3, the horizontal axis represents time, and the vertical axis represents scanning position. This scanning position corresponds to the angle θ formed between the vibrating mirror 224 and the photosensitive drum 226. In FIG. 3, the light beam at times ta and tb is detected by the writing-start-side light beam timing detection unit 227. Further, the light beam at times tc and td is detected by the writing-end-side light beam timing detection unit 228.

In step S401 of FIG. 4, the timing information detection unit 214 detects timing information based on the detected light beam for an n-th scan. The timing information detection unit 214 outputs the timing information to the correction amount prediction unit 215.

The timing information t1n, t2n, and t3n for an n-th scan (n being a natural number) is determined by t1n =tb−ta, t2n=tc−ta, and t3n=td−ta. Further, the elapsed time from the second detection of the light beam at time tb by the writing-start-side light beam timing detection unit 227 shall be denoted as tαn.

The timing information is generated as follows. First, light beam detection information is output to the horizontal synchronizing signal generation unit 221 from the writing-start-side light beam timing detection unit 227 and writing-end-side light beam timing detection unit 228 of an n-th scan, which is the current scan. The horizontal synchronizing signal generation unit 221 outputs a horizontal synchronizing signal to the timing information detection unit 214 based on the light beam detection information. The timing information detection unit 214 generates timing information using the horizontal synchronizing signal, and outputs the generated timing information to the correction amount prediction unit 215.

In step S402, the correction amount prediction unit 215 calculates a correction amount in the following manner based on the timing information and a target value for calculating the correction amount stored in the target value storage unit 213.

In the present exemplary embodiment, letting the main scanning drawing period be ω, when driving the vibrating mirror 224 by a composite wave of a sine wave of angular velocity ωand a sine wave of angular velocity 2ω, the angle θ formed between the vibrating mirror 224 and the photosensitive drum 226 can be expressed using ω as follows.

$$\theta=-A1\sin(\omega t)-A2\sin(2\omega t) \quad (1)$$

Here, the coefficient A1 is the maximum wave amplitude of the sine wave of angular velocity ω, and the coefficient A2 is the maximum wave amplitude of the sine wave of angular velocity 2ω. The curve 301 in FIG. 3 corresponds to equation (1). In the present exemplary embodiment, beam control is performed utilizing the linear change over the section between time tb and time tc.

However, in actual control, jitter occurs in the angle of the vibrating mirror 224 due to air resistance and other factors, so that differences ΔA1 and ΔA2 between the respective target values and the respective actual values occur, and also so that a phase difference ϕ occurs. ΔA1 is the difference between a target value A1 and the actual value A1', ΔA2 is the difference between a target value A2 and the actual value A2', and ϕ is the phase difference between the sine wave of angular velocity ω and the sine wave of angular velocity 2ω. Differences ΔA1 and ΔA2 and phase difference ϕ are determined by a calculation performed by the correction amount prediction unit 215 based on the above-described timing information.

At the correction amount prediction unit 215, the timing information differences Δt1n, Δt2n, and Δt3n are determined based on the drawing timing information t1n, t2n, and t3n of an n-th scan and the target timing information t1, t2, and t3 when controlled by the targeted maximum amplitudes A1 and A2.

$$\Delta t1n=t1n-t1$$

$$\Delta t2n=t2n-t2$$

$$\Delta t3n=t3n-t3 \tag{2}$$

Using the obtained differences Δt1n, Δt2n, and Δt3n, the correction amount prediction unit 215 determines errors ΔA1n, ΔA2n, and ϕn with the target value of an n-th scan from the following matrix calculation.

$$\begin{pmatrix} \Delta A_{1n} \\ \Delta A_{2n} \\ \phi_n \end{pmatrix} = M^{-1} \cdot \begin{pmatrix} \Delta t_{1n} \\ \Delta t_{2n} \\ \Delta t_{3n} \end{pmatrix} \tag{3}$$

$M^{-1}$ is the inverse matrix of the matrix M.

The matrix M is a matrix representing the change in the time taken for a light beam to pass through the light beam timing detection units 227 and 228 when a control parameter including any of maximum amplitudes A1, A2 or phase difference ϕ is slightly changed from the target value. The matrix M can be expressed as follows in terms of the time ta at which θ=θ0 and the target timing information t1n, t2n, and t3*n*.

$$M = \begin{bmatrix} \frac{\partial t}{\partial A1}\Big|_{t1+ta} & -\frac{\partial t}{\partial A1}\Big|_{ta} & \frac{\partial t}{\partial A2}\Big|_{t1+ta} & -\frac{\partial t}{\partial A2}\Big|_{ta} & \frac{\partial t}{\partial \phi}\Big|_{t1+ta} & -\frac{\partial t}{\partial \phi}\Big|_{ta} \\ \frac{\partial t}{\partial A1}\Big|_{t2+ta} & -\frac{\partial t}{\partial A1}\Big|_{ta} & \frac{\partial t}{\partial A2}\Big|_{t2+ta} & -\frac{\partial t}{\partial A2}\Big|_{ta} & \frac{\partial t}{\partial \phi}\Big|_{t2+ta} & -\frac{\partial t}{\partial \phi}\Big|_{ta} \\ \frac{\partial t}{\partial A1}\Big|_{t3+ta} & -\frac{\partial t}{\partial A1}\Big|_{ta} & \frac{\partial t}{\partial A2}\Big|_{t3+ta} & -\frac{\partial t}{\partial A2}\Big|_{ta} & \frac{\partial t}{\partial \phi}\Big|_{t3+ta} & -\frac{\partial t}{\partial \phi}\Big|_{ta} \end{bmatrix}$$

From the thus-determined errors ΔA1n, ΔA2n, and ϕn, the angle θ (t) can be expressed based on equation (1) as follows.

$$\theta(t)=-(A1+\Delta A1n)\sin(\omega t)-(A2+\Delta A2n)\sin(2\omega t+\phi n) \tag{4}$$

From equation (4), the angular velocity θ' (t) of the vibrating mirror 224 at time t can be determined as follows.

$$\theta'(t)=-(A1+\Delta A1n)\omega \cos(\omega t)-2(A2+\Delta A2n)\omega \cos(2\omega t+\phi n) \tag{5}$$

Next, letting the angle formed between the vibrating mirror 224 and the photosensitive drum 226 when the writing-start-side light beam timing detection unit 227 detects the scanning start timing be θ0, the time t0(n+1) from t=0 until the light beam is detected by the writing-start-side light beam timing detection unit 227 (for the waveform of the composite wave drawing the n+1-th scan) can be determined from the following equation.

$$\theta 0=-(A1+\Delta A1n)\sin(\omega t0(n+1))-(A2+\Delta A2n)\sin(2\omega t0(n+1)+\phi n) \tag{6}$$

Using the t0(n+1) determined by equation (6), the t1(n+1) of n+1-th scan, and the tα(n+1), an arbitrary time t can be expressed as follows.

$$t=t0(n+1)+t1(n+1)+t\alpha(n+1) \tag{7}$$

Based on equations (5) and (7), the respective angular velocities θ'(tα(n+1)) can be determined as follows.

$$\theta'(t\alpha(n+1))=(A1+\Delta A1n)\omega \cos(\omega(t0(n+1)+t1(n+1)+t\alpha(n+1)))+2(A2+\Delta A2n)\omega \cos(2\omega(t0(n+1)+t1(n+1)+t\alpha(n+1))+\phi n) \tag{8}$$

Here, letting an ideal angular velocity (target angular velocity) when no error occurs in the angular velocity be θ' ideal, and the drawing time per pixel at such time be tpix_ideal (first drawing time), if there is an error in the angular velocity, then to align the drawing area of one pixel with the ideal case, the drawing time tpix_α (second drawing time) per pixel in the time tα(n+1) has to satisfy the following equation.

$$\theta'(t\alpha(n+1))\cdot tpix_\alpha=\theta'\text{ideal}\cdot tpix_\text{ideal} \tag{9}$$

Further, based on the difference between tpix_α for resolving the error and the actual drawing time tpix_ideal per pixel, the interval into which a pixel piece is inserted/deleted can be decided. Here, this difference can be expressed as in the following equation (10).

$$tpix_\alpha-tpix_\text{ideal}=(\theta'\text{ideal}\cdot tpix_\text{ideal})/\theta'(t\alpha(n+1)-tpix_\text{ideal}=tpix_\text{ideal}(\theta'\text{ideal}/\theta'(t\alpha(n+1))-1) \tag{10}$$

In the present exemplary embodiment, an interval Pi into which a pixel piece is inserted/deleted based on equation (10) can be determined as a function of tα(n+1) as follows.

$$Pi=\theta'(t\alpha(n+1))/(\theta'\text{ideal}-\theta'(t\alpha(n+1))) \tag{11}$$

In this manner, the correction amount prediction unit 215 can calculate the interval into which a pixel piece is deleted or inserted as a correction amount.

Next, in step S403, based on the calculated correction amount and the image data provided from the image generation unit 211, the light beam modulation control unit 216 generates a light beam modulation signal. The light beam modulation control unit 216 partially or fully expands or contracts the scanning line length of the main scanning direction to adjust the drawing time by inserting or deleting a pixel according to the correction amount. A specific example of the processing in the light beam modulation control unit 216 is described next with reference to FIGS. 5 and 6. The remainder of FIG. 4 is also described below.

Figure 5:
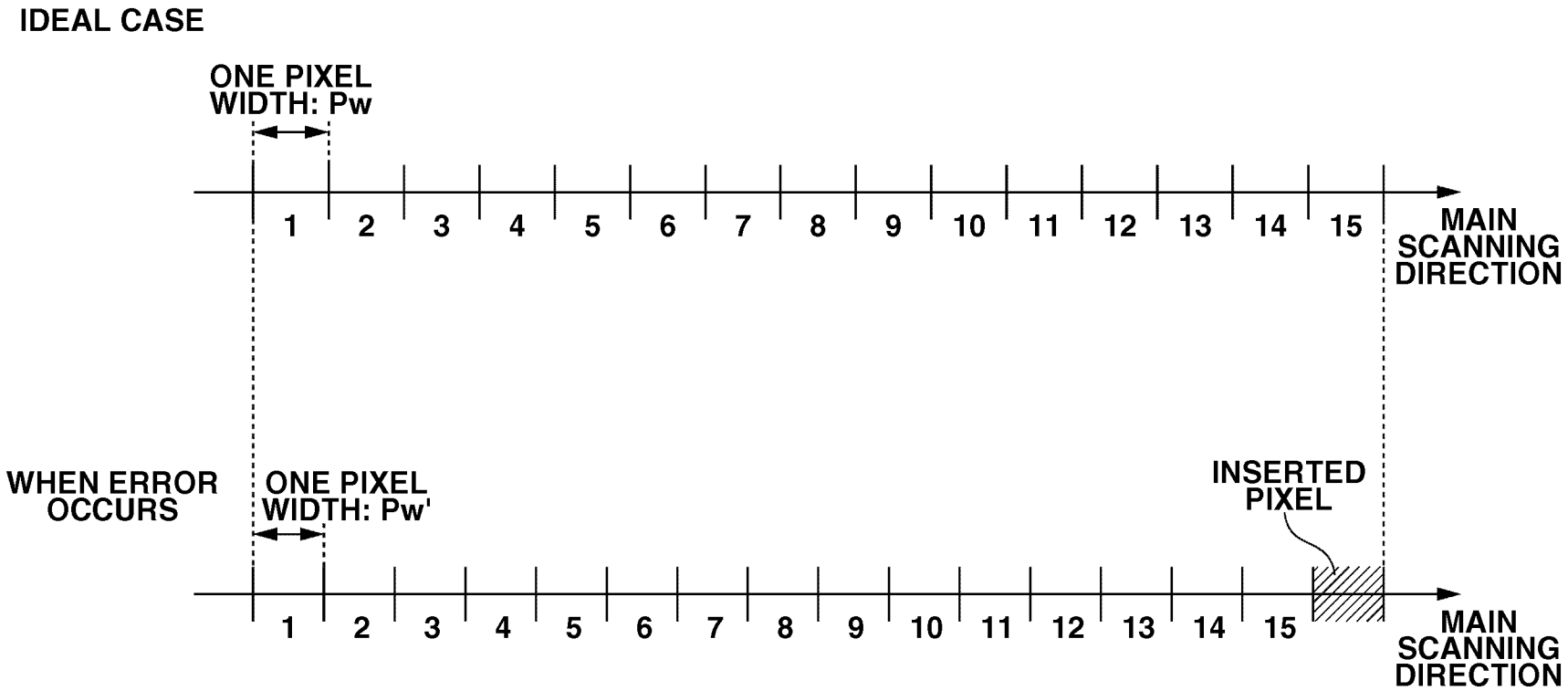
FIG. 5 is a diagram illustrating a correction example through the insertion of a pixel according to the first exemplary embodiment of the present invention.

In FIG. 5, as one example, a case where tpix_α-tpix_ideal=tpix_ideal/15 for a given drawing area is illustrated. Specifically, the actual drawing time tpix_ideal of one pixel is only tpix_ideal/15 shorter than the tpix_α for resolving an error in the case where an error has occurred. Therefore, the correction magnification of the main scanning direction is 16/15=1.07. Assuming the minimum pixel piece is a size of 1/8 of a pixel (tpix_ideal/8), since the magnification of the drawing area can be adjusted by inserting 8 pixel pieces (one pixel amount) per 15 pixels, the pixel insertion interval is every 15 pixels.

Figure 6:
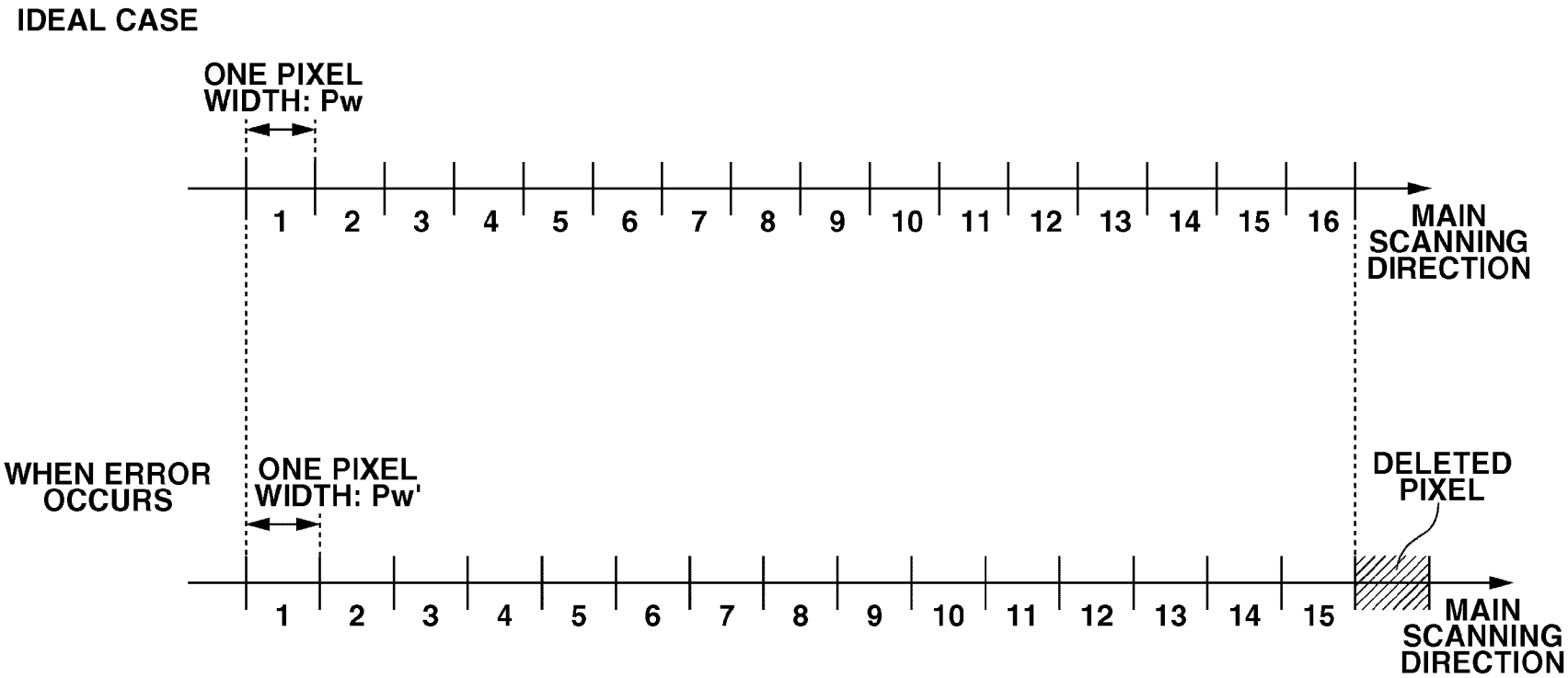
FIG. 6 is a diagram illustrating a correction example through the deletion of a pixel according to the first exemplary embodiment of the present invention.

Further, in FIG. 6, as one example, a case where tpix_α-tpix_ideal=−tpix_ideal/16 for a given drawing area is illustrated. Specifically, the actual drawing time tpix_ideal of a pixel is only tpix_ideal/16 longer than the tpix_α for resolving the error in the case where an error has occurred. Therefore, the correction magnification of the main scanning direction is 15/16=0.94. Assuming the minimum pixel piece is a size of 1/8 of a pixel (tpix_ideal/8), since the drawing area magnification can be adjusted by deleting 8 pixel pieces (one pixel amount) per 16 pixels, the pixel deletion interval becomes every 16 pixels.

Although in FIGS. 5 and 6 cases where a pixel piece was inserted/deleted as a whole one pixel amount were described, the insertion/deletion may also be carried out by dividing up into units of pixel pieces.

In step S404 of FIG. 4, based on the thus-generated light beam modulation signal, the light beam drive unit 212 generates a light beam drive signal, and outputs the signal to the light beam output unit 225 to drive the light beam output unit 225. In step S405, the light beam output unit 225 outputs the light beam to the vibrating mirror 224 according to the fed light beam drive signal, and performs exposure processing of the photosensitive drum 226 via the vibrating mirror 224.

The adjustment of the magnification may also be realized by adjusting through increasing/decreasing the video clock frequency rather than inserting/deleting a pixel piece.

Figure 2A:
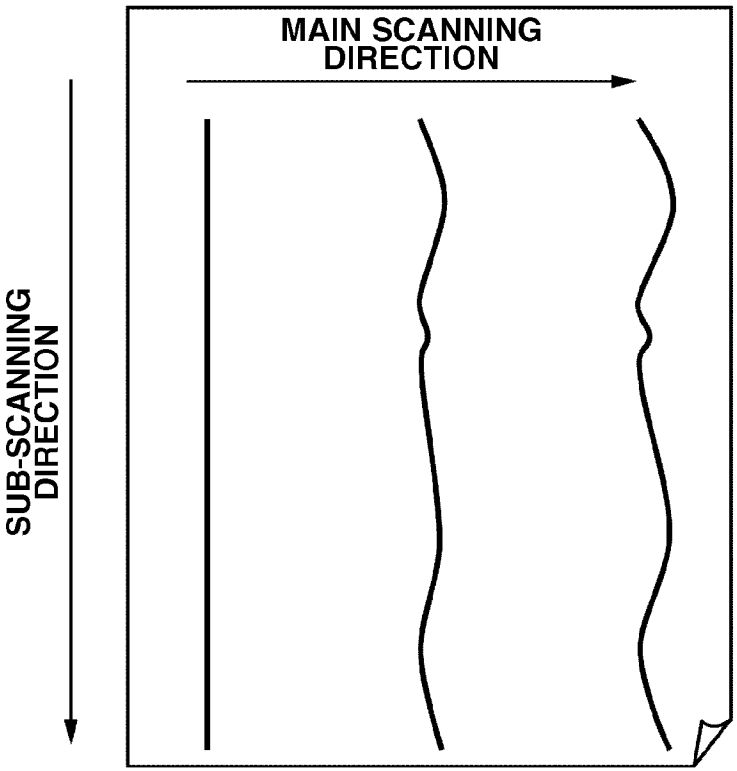
FIG.2A PRIOR ART

In this manner, interpolation/deletion intervals of the pixel vicinity for the next n+1-th scan can be decided based on the drawing timing information of the current n-th scan and the target value. By adjusting the magnification in this manner, image distortion due to the jitter of a vibrating mirror like that illustrated in FIG. 2A can be corrected, so that a good image like that illustrated in FIG. 2B can be obtained.

Second Exemplary Embodiment

While in the above-described first exemplary embodiment the magnification was determined by an equation, the magnification may also be determined by a configuration in which the properties of the vibrating mirror are measured in advance, the relationship between the measurement results and ϕ is retained as data, and the drive is corrected based on this data.

For example, dividing the main scanning direction into s-pieces, and letting the magnification at each area be a1 to as, the magnification coefficient at an area can be expressed as follows using k1 to ks and a constant.

$$ai=a0+ki\cdot\phi(i=1 \text{ to } s)$$

Using the determined partial magnifications a1 to as, a good image can be obtained by correcting the pixel width of the scanning area through pixel piece insertion/deletion or adjustment of the video clock.

Third Exemplary Embodiment

Figure 7:
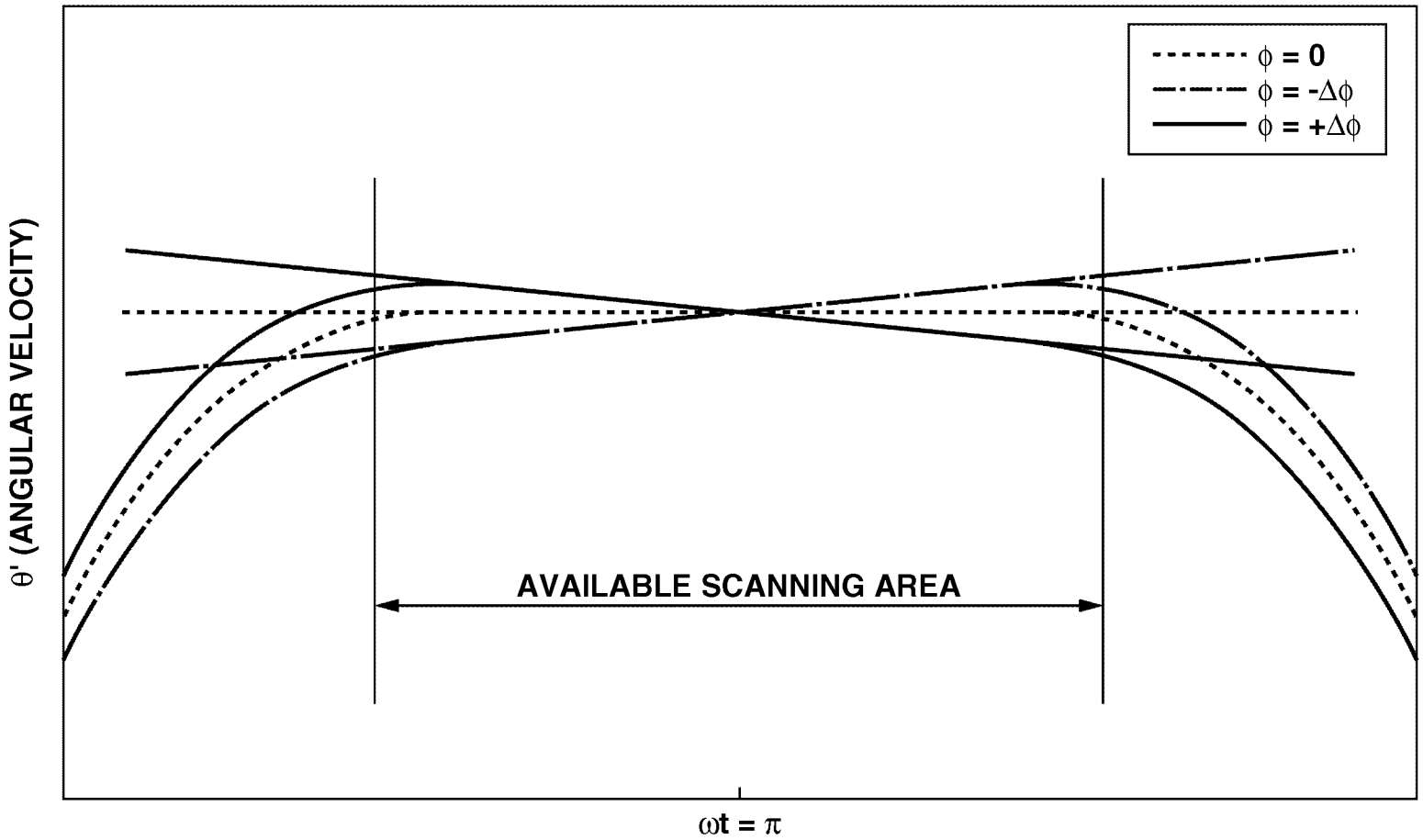
FIG. 7 is a diagram illustrating the relationship between phase difference $\phi$ and angular velocity $\theta'$ according to a third exemplary embodiment of the present invention.

In the above-described second exemplary embodiment, although a partial magnification coefficient is retained for each area, the partial magnification coefficient may also be considered as a proportion of the main scanning direction. FIG. 7 illustrates the relationship between the angular velocity θ' and the phase difference ϕ in an available scanning area. Assuming that the angular velocity θ' in the available scanning area can be approximated by a straight line, the relationship between a position x of a main scanning direction and a correction magnification a can be expressed as in the following equation using a proportional coefficient k of the phase difference ϕ.

$$a(x)=a0+k\cdot\phi\cdot x$$

Using this a(x), a good image can be obtained by correcting the total magnification/partial magnification through pixel piece insertion/deletion of a pixel width of the scanning area, or adjustment of the video clock.

Other Exemplary Embodiments

The present invention may be applied to a system configured from a plurality of devices (such as, for example, a host computer, an interface device, a reader, another reader, and other computer devices and/or peripherals), as well as a system configured from one device (such as, a computer, a copying machine, a facsimile machine, or other processing device).

The present invention can also be achieved by feeding a storage medium storing a computer program code of a software program for realizing the above-described functions to a system, and having this system read and execute the program code. In this case, the storage medium storing this program code, wherein the program code itself read from the storage medium executes the functions of the above-described exemplary embodiments, constitutes an embodiment of the present invention. Further, based on an instruction of that program code, an operating system (OS) or other supporting program running on the computer may perform part or all of the actual processing, and the above-described functions may thus be executed by such processing.

In addition, the program code read from the storage medium may be written in a memory provided on a function expansion card inserted into the computer or a function expansion unit connected to the computer. Based on an instruction of that program code, a CPU or other processor provided on the function expansion card or function expansion unit can perform part or all of the actual processing, and the above-described functions may thus be executed.

A storage medium that stores a program code corresponding to an embodiment of the present invention, which embodiment may be that disclosed in the flowchart described above for example, serves as an embodiment of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-168085filed Jun. 26, 2007, which is here by incorporated by reference herein in its entirety.

What is claimed is:

1. An image forming apparatus comprising:

a light beam output unit configured to output a light beam;

a deflection unit configured to deflection scan a photosensitive member in a main scanning direction by vibrating a mirror to reflect the light beam output from the light beam output unit onto the photosensitive member;

a timing information detection unit configured to detect timing information for a first scan of the deflection scanning by the deflection unit during an image forming;

a calculation unit configured to calculate a difference between:

a target maximum wave amplitude of a frequency component of an angle between the mirror and the photosensitive member, and an maximum wave amplitude of the frequency component of the angle between the mirror and the photosensitive member in the first scan, the calculated difference calculated using the timing information for the first scan, the calculation unit further configured to calculate a correction amount of the main scanning direction for a next scan, the correction amount for attenuating non-periodic jitter of the minor caused by at least one of air resistance and turbulence, the correction amount calculated based on the calculated difference;

a light beam modulation control unit configured to generate a light beam modulation signal for a second scan of image forming during the image forming based on image data and the correction amount calculated based on the timing information for the first scan; and a drive unit configured to drive the light beam output unit based on the light beam modulation signal.

2. The image forming apparatus according to claim 1, wherein the correction amount is a magnification in the main scanning direction of the image data.

3. The image forming apparatus according to claim 1, wherein the correction amount is a deletion interval or an insertion interval of a pixel in the main scanning direction.

4. The image forming apparatus according to claim 1, wherein the calculation unit calculates the correction amount for the next scan for each scan in the main scanning direction.

5. The image forming apparatus according to claim 1, wherein the calculation unit is configured to calculate an angular velocity of the deflection unit for a current scan based on the timing information, and to determine, based on the calculated angular velocity, a target angular velocity, a first drawing time for actually drawing one pixel on the photosensitive member, and a second drawing time of one pixel for resolving an error between the angular velocity and the target angular velocity to calculate the correction amount based a difference between the first drawing time and the second drawing time.

6. A method for controlling an image forming apparatus which has: a light beam output unit configured to output a light beam for exposing a photosensitive member; and a deflection unit configured to deflection scan a photosensitive member in a main scanning direction by vibrating a mirror to reflect the light beam output from the light beam output unit onto the photosensitive member; the method comprising:

detecting timing information for a first scan of the deflection scanning by the deflection unit during an image forming;

calculating a difference between:

a target maximum wave amplitude of a frequency component of an angle between the mirror and the photosensitive member, and an maximum wave amplitude of the frequency component of the angle between the mirror and the photosensitive member in the first scan, the calculated difference calculated using the timing information for the first scan, and calculating a correction amount of the main scanning direction for a next scan, the correction amount for attenuating non-periodic jitter of the mirror caused by at least one of air resistance and turbulence, the correction amount calculated based on the calculated difference;

generating a light beam modulation signal for a second scan of image forming during the image forming based on image data and the correction amount calculated based on the timing information for the first scan; and driving the light beam output unit based on the light beam modulation signal.

7. The method according to claim 6, wherein the correction amount is a magnification in the main scanning direction of the image data.

8. The method according to claim 6, wherein the correction amount is a deletion interval or an insertion interval of a pixel in the main scanning direction.

9. The method according to claim 6, further comprising calculating the correction amount for the next scan for each scan in the main scanning direction.

10. The method according to claim 6, further comprising:

calculating an angular velocity of the deflection unit for a current scan based on the timing information; and determining, based on the calculated angular velocity, a target angular velocity, a first drawing time for actually drawing one pixel on the photosensitive member, and a second drawing time of one pixel for resolving an error between the angular velocity and the target angular velocity to calculate the correction amount based a difference between the first drawing time and the second drawing time.

11. A storage medium storing a computer program for executing the method according to claim 6 in a computer.

* * * * *